US007747182B2

(12) United States Patent
Kato et al.

(10) Patent No.: US 7,747,182 B2
(45) Date of Patent: Jun. 29, 2010

(54) IMAGE FORMING APPARATUS WITH TONER DENSITY CONTROL

(75) Inventors: Shinji Kato, Kanagawa (JP); Shin Hasegawa, Kanagawa (JP); Kohta Fujimori, Kanagawa (JP); Nobutaka Takeuchi, Kanagawa (JP); Kayoko Tanaka, Tokyo (JP); Yushi Hirayama, Kanagawa (JP); Kazumi Kobayashi, Tokyo (JP); Kiichirou Shimizu, Kanagawa (JP); Takashi Enami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 741 days.

(21) Appl. No.: 11/558,731

(22) Filed: Nov. 10, 2006

(65) Prior Publication Data

US 2007/0110457 A1 May 17, 2007

(30) Foreign Application Priority Data

Nov. 11, 2005 (JP) ..... 2005-327625

(51) Int. Cl.
*G03G 15/08* (2006.01)

(52) U.S. Cl. ..... 399/30; 399/27; 399/61; 399/62; 399/63

(58) Field of Classification Search ..... 399/27, 399/30, 49, 58, 61–62, 253, 255, 258, 259
See application file for complete search history.

(56) References Cited

U.S. PATENT DOCUMENTS 5,327,196 A 7/1994 Kato et al.
5,493,382 A 2/1996 Takagaki et al.
5,604,575 A 2/1997 Takagaki et al.
5,737,680 A 4/1998 Takagaki et al.
6,404,997 B1 6/2002 Grace
6,501,916 B2 * 12/2002 Suzuki ..... 399/30

(Continued)

FOREIGN PATENT DOCUMENTS

EP 0 487 009 A2 5/1992

(Continued)

OTHER PUBLICATIONS

U.S. Appl. No. 11/932,198, filed Oct. 31, 2007, Takeuchi, et al.

(Continued)

*Primary Examiner*—David M Gray
*Assistant Examiner*—G. M. Hyder
(74) *Attorney, Agent, or Firm*—Oblon, Spivak, McClelland, Maier & Neustadt, L.L.P.

(57) ABSTRACT

An image forming apparatus in which a predetermined image density can be obtained by correcting a toner density control target value without consuming toner. The toner density of the developer is controlled so that an output value Vt of a magnetic permeability sensor approaches a target output value $Vt_{ref}$. In addition, the target output value $Vt_{ref}$ is corrected in accordance with image coverage history information of output images transferred to a transfer paper and image coverage ratio history information of output images determined from the image coverage thereof and the size of the transfer paper. This history information comprises, for example, a cumulative average value of the image coverage or the image coverage ratio per transfer paper. It may also comprise a moving average value of the image coverage or the image coverage ratio per transfer material.

9 Claims, 11 Drawing Sheets

U.S. PATENT DOCUMENTS

| | | | | |
|---|---|---|---|---|
| 6,771,911 | B2 * | 8/2004 | Ko | 399/27 |
| 2004/0184826 | A1 * | 9/2004 | Ozawa et al. | 399/30 |
| 2004/0228642 | A1 * | 11/2004 | Iida et al. | 399/27 |
| 2005/0100355 | A1 * | 5/2005 | Suzuki et al. | 399/27 |
| 2006/0127109 | A1 * | 6/2006 | Itoyama et al. | 399/27 |
| 2006/0263106 | A1 * | 11/2006 | Yamaguchi et al. | 399/27 |
| 2007/0003324 | A1 * | 1/2007 | Gross et al. | 399/257 |
| 2007/0036566 | A1 * | 2/2007 | Takeuchi et al. | 399/27 |
| 2007/0116480 | A1 * | 5/2007 | Takeuchi et al. | 399/27 |
| 2007/0122168 | A1 * | 5/2007 | Tanaka et al. | 399/27 |
| 2008/0145078 | A1 * | 6/2008 | Tomita et al. | 399/60 |
| 2008/0205923 | A1 * | 8/2008 | Takeuchi et al. | 399/62 |

FOREIGN PATENT DOCUMENTS

| | | |
|---|---|---|
| JP | 57-136667 | 8/1982 |
| JP | 2-34877 | 2/1990 |
| JP | 7-234582 | 9/1995 |
| JP | 10-282740 | 10/1998 |

OTHER PUBLICATIONS

U.S. Appl. No. 12/112,525, filed Apr. 30, 2008, Koizumi, et al.
U.S. Appl. No. 12/093,753, filed May 15, 2008, Oshige et al.
U.S. Appl. No. 12/094,198, filed May 19, 2008, Kato et al.
U.S. Appl. No. 07/811,056, filed Dec. 20, 1991, Kouji Ishigaki, et al.
U.S. Appl. No. 11/856,304, filed Sep. 17, 2007, Oshige, et al.

* cited by examiner

| MOVING AVERAGE VALUE OF IMAGE COVERAGE RATIO [%] | ΔTC [wt%] | ΔVtref [V] |
|---|---|---|
| M(i) <1 | 0.5 | -0.15 |
| 1 ≦ M(i) <2 | 0.4 | -0.12 |
| 2 ≦ M(i) <3 | 0.3 | -0.09 |
| 3 ≦ M(i) <4 | 0.2 | -0.06 |
| 4 ≦ M(i) <6 | 0.0 | 0.00 |
| 6 ≦ M(i) <7 | -0.1 | 0.03 |
| 7 ≦ M(i) <8 | -0.2 | 0.06 |
| 8 ≦ M(i) <9 | -0.3 | 0.09 |
| 9 ≦ M(i) <10 | -0.4 | 0.12 |
| 10 ≦ M(i) <20 | -0.5 | 0.15 |
| 20 ≦ M(i) <30 | -0.6 | 0.18 |
| 30 ≦ M(i) <40 | -0.7 | 0.21 |
| 40 ≦ M(i) <50 | -0.8 | 0.24 |
| 50 ≦ M(i) <60 | -0.9 | 0.27 |
| 60 ≦ M(i) <70 | -1.0 | 0.30 |
| 70 ≦ M(i) <80 | -1.0 | 0.30 |
| 80 ≦ M(i) | -1.0 | 0.30 |

*Fig. 8*

IMAGE FORMING APPARATUS WITH TONER DENSITY CONTROL

BACKGROUND OF THE INVENTION

1. Field of the Invention

The present invention relates to an image forming apparatus such as a copier, a printer and a facsimile device, and more particularly relates to an image forming apparatus that performs image formation employing a two-component developer comprising a toner and a magnetic carrier.

2. Description of the Related Art

Two-component development systems in which a two-component developer (hereinafter referred to simply as "developer") comprising a toner and a magnetic carrier is carried on a developer carrier and in which development is carried out as a result of a magnetic brush being formed from the developer by magnetic poles provided within the developer carrier and a latent image on a latent image carrier being rubbed by the magnetic brush are widely known in the prior art. Two-component development systems are being widely utilized because of the simplicity of coloring they afford. When the toner density as an expression of the ratio (for example, weight ratio) of the toner and magnetic carrier in a developer in a two-component developer system is too high, blemishes and a depot in the fine resolution of the formed image occur. On the other hand, when the toner density lowers, the density of the solid image portion drops and adhesion of the carrier to the latent image carrier occurs. Accordingly, it is essential that a toner density control involving the control of a toner supply operation based on the detection of the toner density in the developer of the development apparatus to be performed to always maintain the toner density in the developer within the appropriate range.

In addition, it is essential that the image forming performed by the image forming apparatus be performed in a way that in general always produces a constant image density. Image density is principally determined by the development capability of the development apparatus. Development capability, which refers to a capability that expresses the extent to which toner can be adhered to a latent image during development, changes in accordance with, in addition to toner density, development conditions such as development potential or the toner charge amount contributing to development. A gradient (development $\gamma$) of a relational expression that describes the toner adhered amount with respect to the development potential is widely used as an index for denoting development capability. Because the image density is determined by the development capability of the development apparatus in this way, performing the toner density control alone described above to produce a toner density that is always within the appropriate range cannot produce a constant image density. In addition, even though it is comparatively easy to ensure development conditions such as the development potential are made constant, ensuring the toner charge amount contributing to development is made constant is difficult. Accordingly, there is a drawback inherent thereto in that, even if the development conditions are made constant and, in addition, a toner density control is performed to ensure the toner density is made constant, unless the development capability can be made constant a constant image density cannot be produced.

More specifically, for example when an image of low image coverage ratio is output, because the amount of toner used to develop this image is comparatively small, a small amount of toner is supplied to maintain the prescribed toner density. Accordingly, a large amount of toner is present in the development apparatus for a comparatively long time.

Because the toner present in the development apparatus for a comparatively long time is subjected to an agitating action for a long time, most of the toner contributing to development is sufficiently charged to the desired charge amount. Accordingly, this gives rise to a comparatively high development capability. In contrast, when an image of high image coverage ratio is output, a large amount of just supplied new toner that has not been sufficiently charged is present (in the development apparatus), and a large ratio of the toner contributing to development is occupied by toner that has not been sufficiently charged to the prescribed charge amount. As a result, a comparatively low development capability is created. More particularly, to meet the demand for the compacting of development apparatuses that has occurred in recent years, the trend is towards as far as possible minimizing the amount of developer that is held in the development apparatus. Accordingly, for image formation performed following the output of an image of high image coverage ratio, the ratio of toner contributing to development that has not been sufficiently charged to the desired charge amount is greater. Accordingly, a comparative increase in the development capability during the image formation that follows the output of an image of high image coverage ratio is liable to be created.

In addition, based on this configuration, it is possible for the development capability when an image of low image coverage ratio is output to be higher than that when an image of high image coverage ratio is output. For example, employing a toner to which an external additive has been adhered and employing a development apparatus in which this toner creates a high stress, as a result of the toner present for a comparatively long time in the development apparatus being subjected to an agitation action for a long period, the external additive becomes either embedded in the toner surface or separates from the toner surface. Where this happens to a lot of the toner, a worsening of the fluidity of the developer occurs, the charge capability of the toner itself drops, and the toner contributing to development cannot be sufficiently charged to the desired charge amount. Accordingly, when an image of low image coverage ratio is output, because of the increase in the ratio of toner contributing to development that is not sufficiently charged to the desired charge amount, a comparatively large development capability is created. In contrast, because of the large amount of supplied toner when an image of high image coverage ratio is output, the amount of toner present for a comparatively long time in the development apparatus is small. Accordingly, the developer has good fluidity and, in addition, most of the toner has a sufficiently high charge capability. Accordingly, because the toner contributing to development can be sufficiently charged to the desired charge amount, a comparatively low development capability is created.

As is described above, differences in development capability between when an image of low image coverage ratio is output and an image of high area ratio is output are produced because of the difference in the ratio of the toner present in the development apparatus caused by the subsequent toner supply. Accordingly, there is a drawback inherent thereto in that, even if the development conditions are made constant and, in addition, a toner density control is performed to ensure the toner density is made constant, unless the development capability can be made constant a constant image density cannot be produced.

Examples of image forming apparatuses able to suppress this drawback include the apparatuses described in Japanese Unexamined Patent Application No. S57-136667 and Japanese Unexamined Patent Application No. H2-34877. In these image forming apparatuses, which comprise toner density detection means for detecting and outputting the toner density of a two-component developer of a development apparatus, a control that involves a comparison of the output value of toner density detection means and a toner density control standard value and the control of toner supply device based on the comparative result thereof so that the toner density of the developer within the development apparatus is produced in the desired toner density is performed. In addition, the density of a standard toner pattern formed in a non-imaging part is detected and, as a result, the image density during the forming of the standard pattern is ascertained and, based on the detected result thereof, a toner density control target value is corrected. Based on this method, image formation at the desired image density can be performed for a short time period following this correction. Accordingly, forming a standard toner pattern and regularly correcting the toner density control target value in response to the detected result thereof can produce a constant image density.

However, in the image forming apparatuses described in these applications, standard toner patterns must be formed to the extent that the toner density control target value is corrected. Accordingly, and inherent problem thereof is the increased use of the amount of toner not employed in the image formation.

SUMMARY OF THE INVENTION

With the foregoing in view, it is an object of the present invention to provide an image forming apparatus able to produce a constant image density by correcting a toner density control target value without consuming toner.

In accordance with the present invention, an image forming apparatus comprises a latent image carrier; a development apparatus in which a developer containing a toner and a magnetic carrier is carried on a developer carrier and which performs development in which, by bringing the developer on the developer carrier into contact with the surface of the latent image carrier, the toner is adhered to the latent image on the surface of the latent image carrier; a toner supply apparatus for supplying the toner to the development apparatus; a toner density detection device for detecting and outputting toner density of the developer in the development apparatus; a toner density control device for controlling the toner density of the developer so that an output value of the toner density detection device approximates a toner density control standard value; a transfer device for transferring an image on the latent image carrier onto a transfer material; and a correction device for correcting the toner density control standard value on the basis of image coverage history information of an output image transferred to the transfer material or image coverage ratio history information of an output image determined from the image coverage and the transfer material size.

BRIEF DESCRIPTION OF THE DRAWINGS

The above and other objects, features and advances of the present invention will become more apparent from the following detailed description based on the accompanying drawings in which:

FIG. 8 is a diagram showing an example of an LUT in which the sensitivity of the magnetic permeability sensor is 0.3;

DESCRIPTION OF THE PREFERRED EMBODIMENTS

A first embodiment of the present invention having application in an electrophotographic-type color laser printer (hereinafter referred to as a "laser printer") serving as an image forming apparatus will be hereinafter described.

Figure 1:
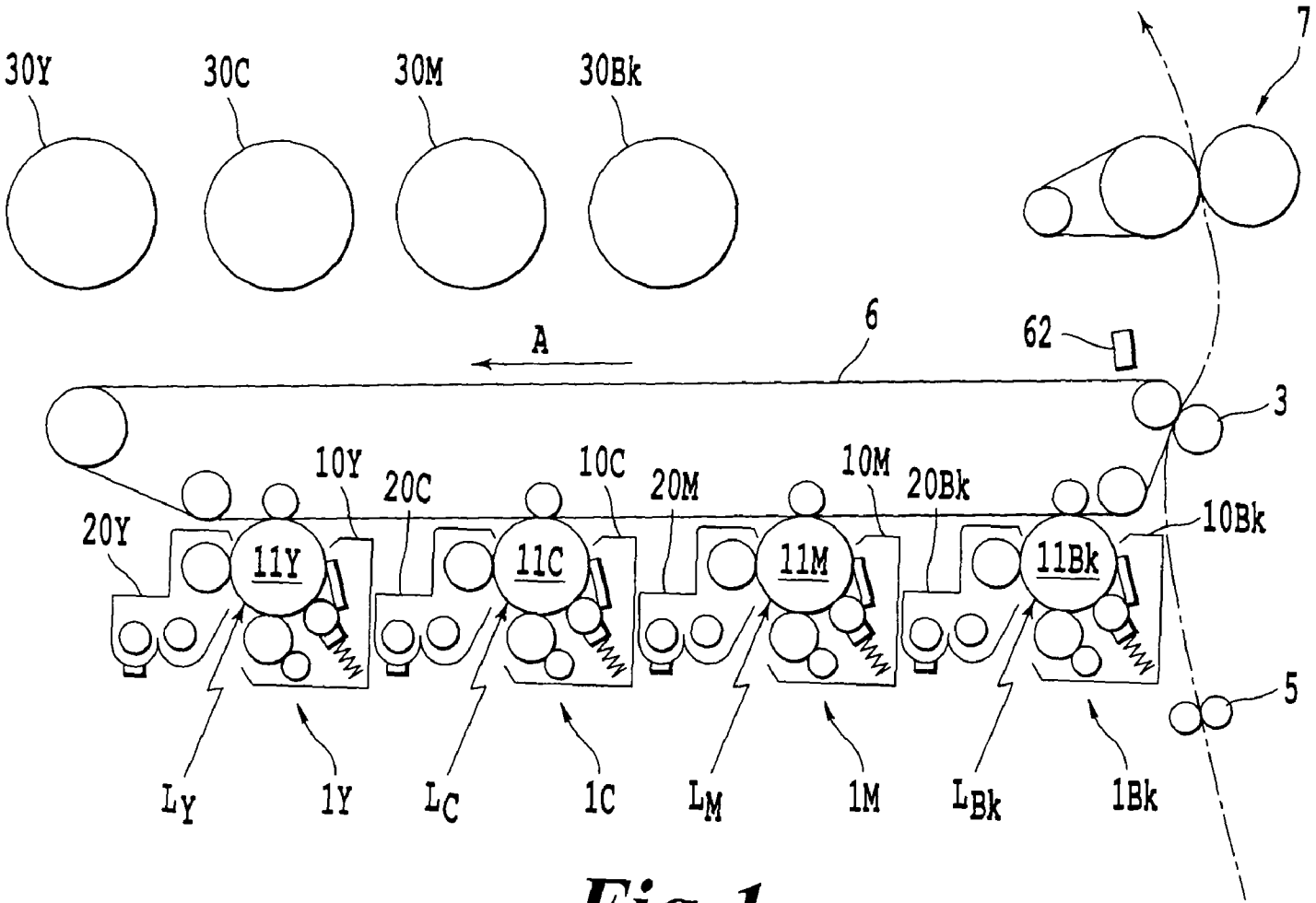
FIG. 1 is a schematic configuration diagram of the main part of a laser printer of a first embodiment of the present invention.

FIG. 1 shows the schematic configuration of the main part of a laser printer pertaining to the present embodiment. The laser printer comprises four sets of imaging means 1Y, 1C, 1M, 1BK (hereinafter the annotated symbols Y, C, M, BK are used to denote yellow, cyan, magenta and black members respectively) for forming images of the colors magenta (M), cyan (C), yellow (Y) and black (BK) arranged in order from the upstream side in the direction of movement of the surface of an intermediate transfer belt 6 serving as an intermediate transfer member (direction of the arrow A in the drawing) The imaging means 1Y, 1C, 1M, 1BK each comprise photoreceptor units 10Y, 10C, 10M, 10BK having drum-like photoreceptors 11Y, 11C, 11M, 11BK serving as latent image carriers, and development apparatus 20Y, 20C, 20M, 20BK. In addition, the arrangement of the imaging means 1Y, 1C, 1M, 1BK is established so that the rotational axes of the photoreceptors 11Y, 11C, 11M, 11BK of the photoreceptor units are parallel and orientated in a prescribed pitch in the direction of movement of the surface of the intermediate transfer belt 6.

The toner images on the photoreceptors 11Y, 11C, 11M, 11BK formed by imaging means 1Y, 1C, 1M, 1BK are sequentially overlapped and primary transferred onto the intermediate transfer belt 6. Accompanying the movement of the surface of the intermediate transfer belt 6, these color images obtained by superposing are carried to a secondary transfer unit between secondary transfer rollers 3. In this laser printer, in addition to imaging means 1Y, 1C, 1M, 1BK, an optical writer unit not shown in the diagram is arranged therebelow, and a paper supply cassette not shown in the diagram is arranged further therebelow. The single dotted line in the diagram indicates the carry path of the transfer paper. The transfer paper serving as the transfer material (recording medium) which is supplied from the paper cassette is carried by carry rollers while being guided by a carry guide not shown in the diagram and forwarded to a temporary stop position in which resist rollers 5 are provided. The transfer paper is supplied to the secondary transfer unit at a prescribed timing by the resist rollers 5. The color image formed on the intermediate transfer belt 6 is secondary transferred onto the transfer paper forming a color image on the transfer paper. The transfer paper on which this color image has been formed is discharged to a discharge paper tray 8 which constitutes a discharge paper unit following the fixing of a toner image by a fixing unit 7 serving as fixing means.

Figure 2:
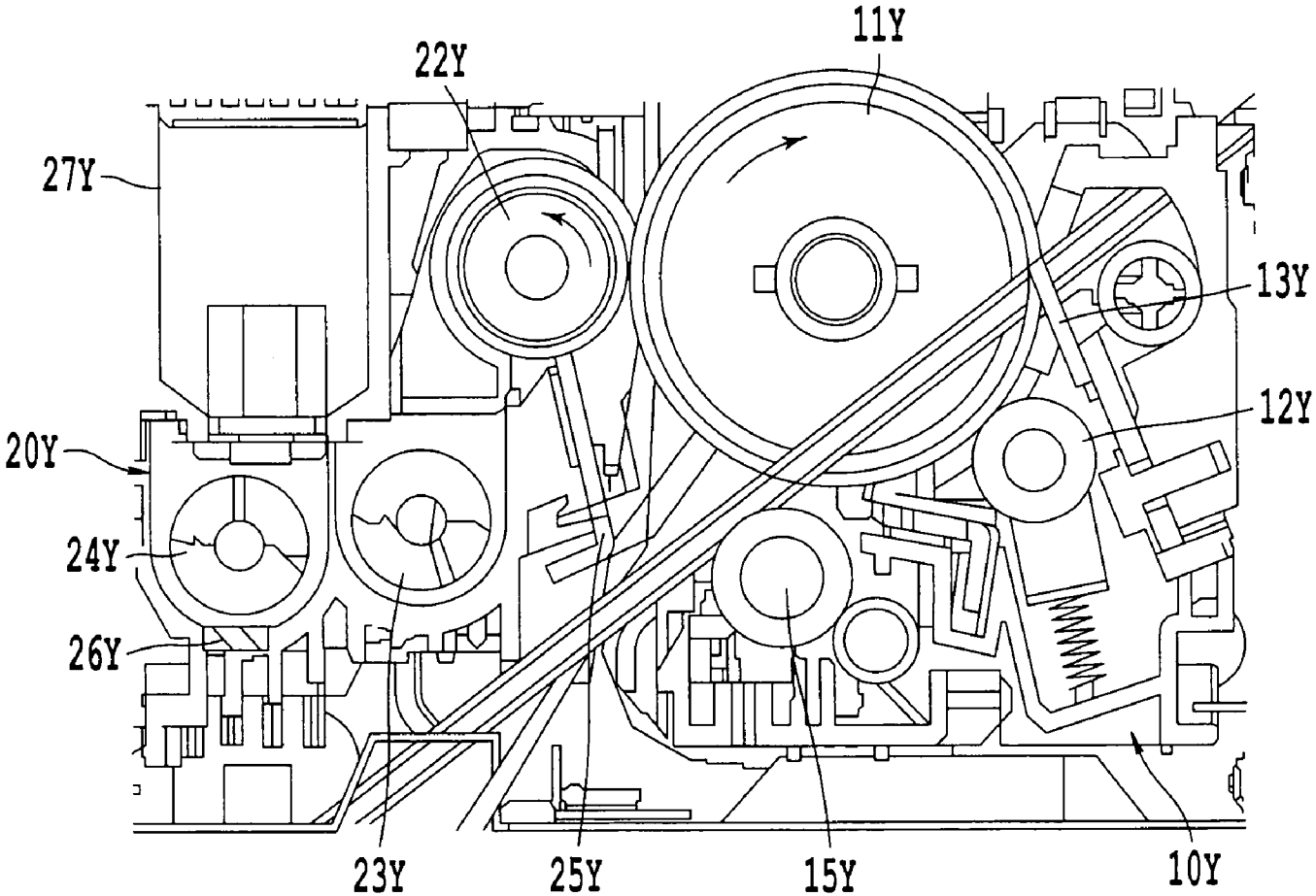
FIG. 2 is a schematic configuration diagram of a yellow imaging means of the imaging means of the laser printer.

FIG. 2 shows the schematic configuration of yellow imaging means 1Y of imaging means 1Y, 1C, 1M, 1BK. The remaining imaging means 1M, 1C, 1BK have an identical configuration thereto and, accordingly, the description thereof has been omitted.

Imaging means 1Y in the diagram comprises, as described above, a photoreceptor unit 10Y and a development apparatus 20Y. The photoreceptor unit 10Y comprises, for example, in addition to the photoreceptor 11Y, a cleaning blade 13Y for cleaning the photoreceptor surface and a charge roller 15Y serving as charge means for uniformly charging the photoreceptor surface. It further comprises a lubricant coating decharging brush roller 12Y with the dual function of coating a lubricant to the photoreceptor surface and decharging the photoreceptor surface. The brush part of the lubricant-coating decharging brush roller 12Y is configured from electroconductive fibers, and a decharging power source not shown in the diagram for imparting a decharging bias is connected to a core metal part thereof.

The surface of the photoreceptor 11Y of the photoreceptor unit 10Y of the configuration described above is uniformly charged by the charge roller 15Y to which a voltage has been imparted. When a laser light $L_Y$ modulated and polarized by the optical writer unit not shown in the diagram is scanned and irradiated on the surface of the photoreceptor 11Y, an electrostatic latent image is formed on the surface of the photoreceptor 11Y. The electrostatic latent image on the photoreceptor 11Y is developed by a later-described development apparatus 20Y resulting in the formation of a yellow toner image. Using a primary transfer unit in which the photoreceptor 11Y and intermediate transfer belt 6 are opposing, the toner image on the photoreceptor 11Y is transferred onto the intermediate transfer belt 6. The surface of the photoreceptor 11Y following the transfer of the toner image therefrom is cleaned by the cleaning blade 13Y serving as photoreceptor cleaning means, and is then coated with a prescribed amount of lubricant by the lubricant-coating decharging brush roller 12Y and decharged by way of preparation for forming the next electrostatic latent image.

The development apparatus 20Y uses a two-component developer containing a magnetic carrier and a negatively charged toner (hereinafter simply referred to as "developer") serving as a developer for developing the abovementioned electrostatic latent image. The development apparatus 20Y additionally comprises, for example, a development sleeve 22Y configured from a non-magnetic material serving as a developer carrier which is disposed so as to be partially exposed from an opening of the photoreceptor side of a development case, a magnetic roller (not shown in the diagram) as magnetic field generating means which is fixedly-arranged in the interior of the development sleeve 22Y, agitating carry screws 23Y, 24Y that serve as agitating carry members, development doctor 25Y, magnetic permeability sensor 26Y serving as toner density detection means, and a powder pump 27Y serving as a toner supply apparatus. A development bias voltage comprising an alternating-current voltage AC (alternating component) overlaid on a negative direct-current voltage DC (direct current component) by a development bias power source not shown in the diagram which serves as development magnetic field forming means is imparted to the development sleeve 22Y, whereupon the development sleeve 22Y is biased to a prescribed voltage with respect to a metal base layer of the photoreceptor 11Y. The development bias voltage may be established to impart a negative direct current voltage DC (direct current component) only.

As a result of the agitated carry by the agitated carry screws 23Y, 24Y of the developer housed in the development case of FIG. 2, the toner is frictionally charged. Some of the developer of a first agitation carry path in which the first agitated carry screw 23Y is arranged is carried on the surface of the development sleeve 22Y and, after adjustment of the layer thickness thereof by the development doctor 25Y, is carried to a development region opposing the photoreceptor 11Y. In the development region, the toner of the developer on the development sleeve 22Y is adhered by a development magnetic field to the electrostatic latent image on the photoreceptor 11Y and a toner image is formed. Following this, the developer that has passed through the development region separates from the development sleeve 22Y at a developer separation electrode position on the development sleeve 22Y and is returned to the first agitation carry path. The developer carried along the first agitation carry path to the downstream end thereof is moved to the upstream end of the second agitation carry path in which the second agitation carry screw 24Y is arranged, and toner is supplied to the second agitation carry path. Following this, the developer carried along the second agitation carry path to the downstream end thereof is moved to the upstream end of the first agitation carry path. The magnetic permeability sensor 26Y is arranged in the development case section from which the base part of the second agitation carry path is configured.

The toner density of the developer in the development case drops accompanying image formation in accordance with toner usage and, accordingly, based on an output value Vt of the magnetic permeability sensor 26Y, it is controlled to the appropriate range by toner supplied in accordance with need by the powder pump 27Y from the toner cartridge 30Y shown in FIG. 2. The toner supply control is performed on the basis of a difference value Tn ($=Vt_{ref}-Vt$) between a target output value $Vt_{ref}$ which constitutes a toner density control standard value and an output value Vt so that when this difference value Tn is + (plus) and the toner density is judged to be sufficiently high there is no toner supplied, and so that when this difference value Tn is − (minus) the toner supply amount is increased by the amount that the absolute value of the difference value Tn has been increased so that the output value Vt approximates the value of the target output value $Vt_{ref}$.

In addition, the target output value $Vt_{ref}$, charge electric potential and light quantity and so on are adjusted by a process control at a frequency of once every image formation copy number of 10 (for approximately 5 to 200 copies depending on copy speed and the plurality of half-tones and solid patterns formed on the photoreceptor 11Y is detected by a reflection density sensor 62 serving as image density detection means shown in FIG. 1, whereupon the amount of adhered toner is ascertained from the detected value thereof and the target output value $Vt_{ref}$, charge electric potential and quantity of light and so on are adjusted to ensure the amount of adhered toner reaches the target adhered amount.

Furthermore in the present embodiment, separately to the process control, a target output value correction processing for correcting the target output value $Vt_{ref}$ is executed for each individual image forming operation (print job). The specific details of this target output value correction processing will be described later in conjunction with a description of the particulars of the toner density control.

In addition, of the four photoreceptors 11Y, 11C, 11M, 11BK, only the photoreceptor 11BK for the color black located at the most downstream side is provided in a constant transfer nip contact state in which it is constantly in contact with the intermediate transfer belt 6, the remaining photoreceptors 11M, 11C, 11Y being provided in an isolated state with respect to the intermediate transfer belt. When a color image is being formed on transfer paper each of the four photoreceptors 11Y, 11C, 11M, 11BK abut the intermediate transfer belt 6. On the other hand, when a monochromatic image of black only is being formed on transfer paper, the photoreceptors 11Y, 11C, 11M for each of the other colors are isolated from the intermediate transfer belt 6 and only the photoreceptor 11BK for the color black in which a toner image is formed using black toner is caused to abut the intermediate transfer belt 6.

A control unit serving as control means for performing the toner density control will be hereinafter described.

Figure 3:
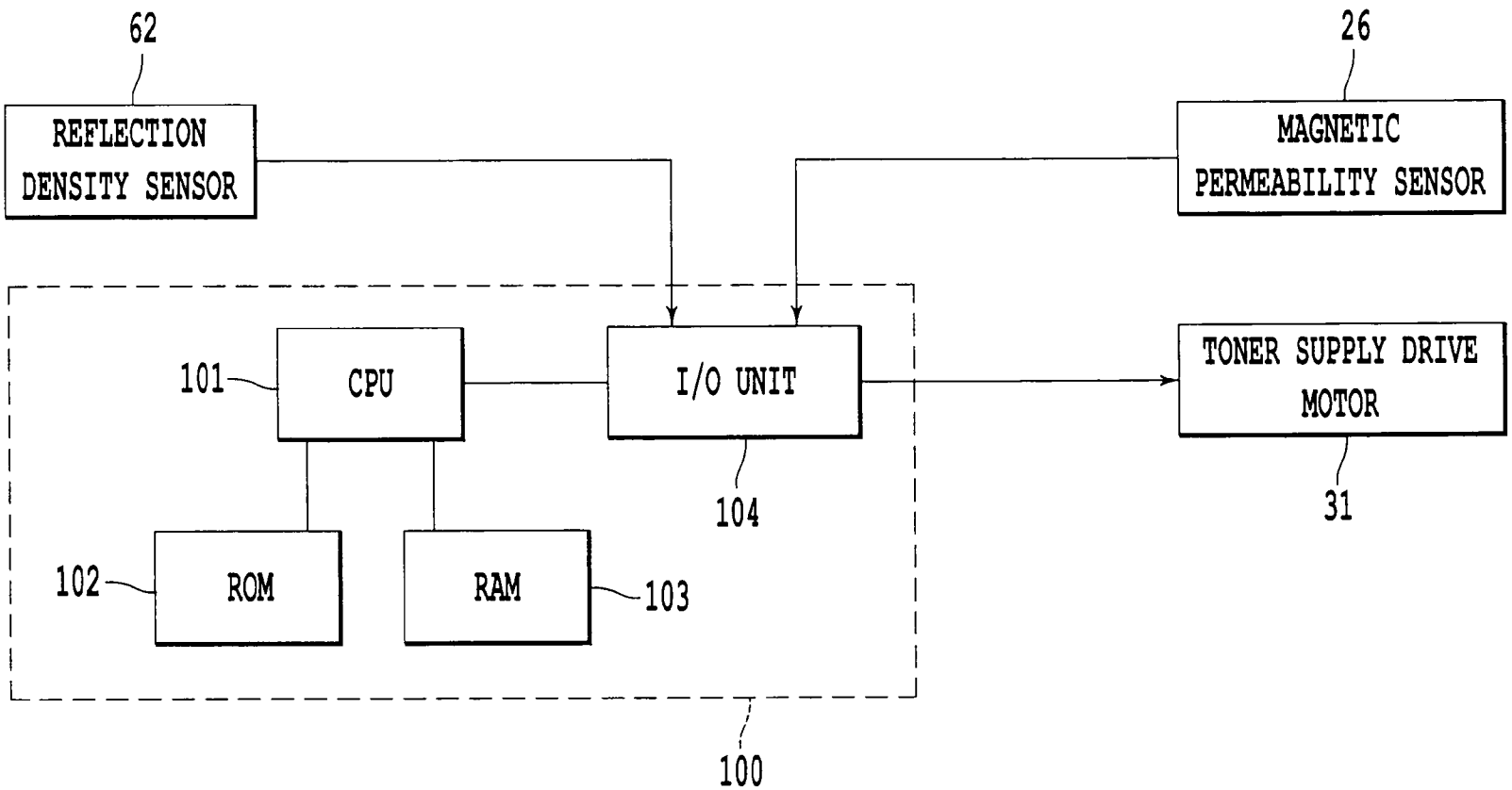
FIG. 3 is a diagram of the configuration of a control unit for performing toner density control in the laser printer.

FIG. 3 shows the configuration of a control unit for performing the toner density control.

A control unit 100 is provided in each development apparatus and, because the fundamental configuration of each is identical, the color differentiating symbols (Y, C, M, BK) have been omitted from the following description. Some component parts (CPU 101, ROM 102, RAM 103 and so on) of the control unit 100 of the development apparatus are shared by the development apparatuses.

The control unit 100 of the present embodiment is configured from, for example, a CPU 101, ROM 102, RAM 103, I/O unit 104. The magnetic permeability sensor 26 and reflection density sensor 62 are respectively connected to the I/O unit 104 by way of A/D converters not shown in the diagram. The control unit 100, as a result of the CPU 101 executing a prescribed toner density control program, performs a toner supply operation in which a control signal is transmitted by way of the I/O unit 104 to a toner supply drive motor 31 for driving a power pump 27. By the additional executing thereby of a prescribed target output value correction program, the target output value Vtref for each individual image formation operation (print job) is corrected to ensure a constant image density is always produced. The toner density control program and target output value correction program and so on executed by the CPU are stored in the ROM 102. The RAM 103 comprises, for example, a Vt resistor for temporarily housing the output value Vt of the magnetic permeability sensor 26 acquired by way of the I/O unit 104, a Vtref resistor for storing a standard output value Vtref output by the magnetic permeability sensor 26 when the toner density of the developer in the development apparatus 20 is equivalent to the target toner density, and a Vs resistor for storing an output value Vs from the reflection density sensor 62.

Figure 4:
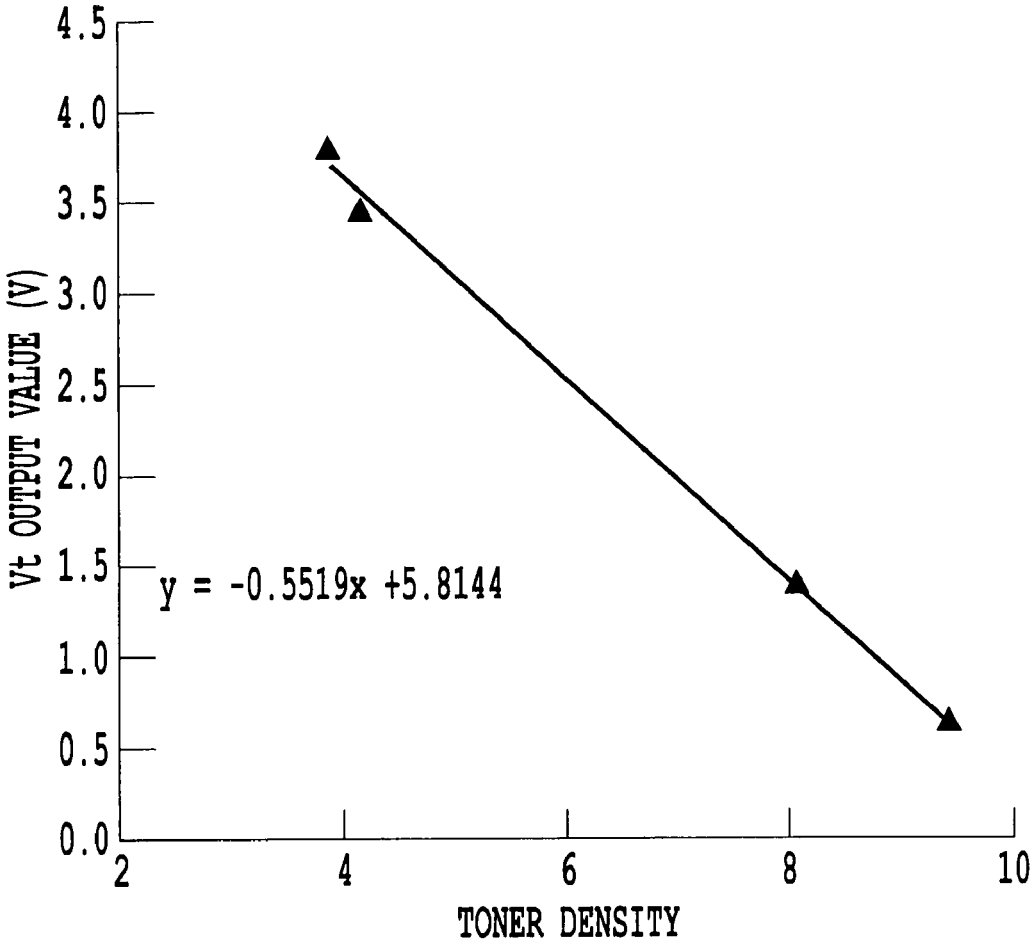
FIG. 4 is a graph in which the vertical axis denotes the output value of a magnetic permeability sensor and the horizontal axis denotes toner density of a developer for detection.

FIG. 4 is a graph in which the vertical axis denotes the output value of the magnetic permeability sensor 26 and the horizontal axis denotes the toner density of the developer serving as the detection subject. As shown in the graph, in the range of the actually used toner density the relationship between the output value of the magnetic permeability sensor 26 and the toner density of the developer approximates a straight line. In addition, the graph illustrates a characteristic whereby the higher the toner density of the developer the lower the output value of the magnetic permeability sensor 26. Utilizing this characteristic, the powder pump 27 is driven to supply toner when the output value Vt of the magnetic permeability sensor 26 is larger than the target output value $Vt_{ref}$. The toner supply control of the present embodiment is performed in accordance with the output value Vt of the magnetic permeability sensor 26 for each individual image formation operation (print job).

The target output value correction processing which constitutes a characterizing portion of the present embodiment will be hereinafter described.

Figure 5:
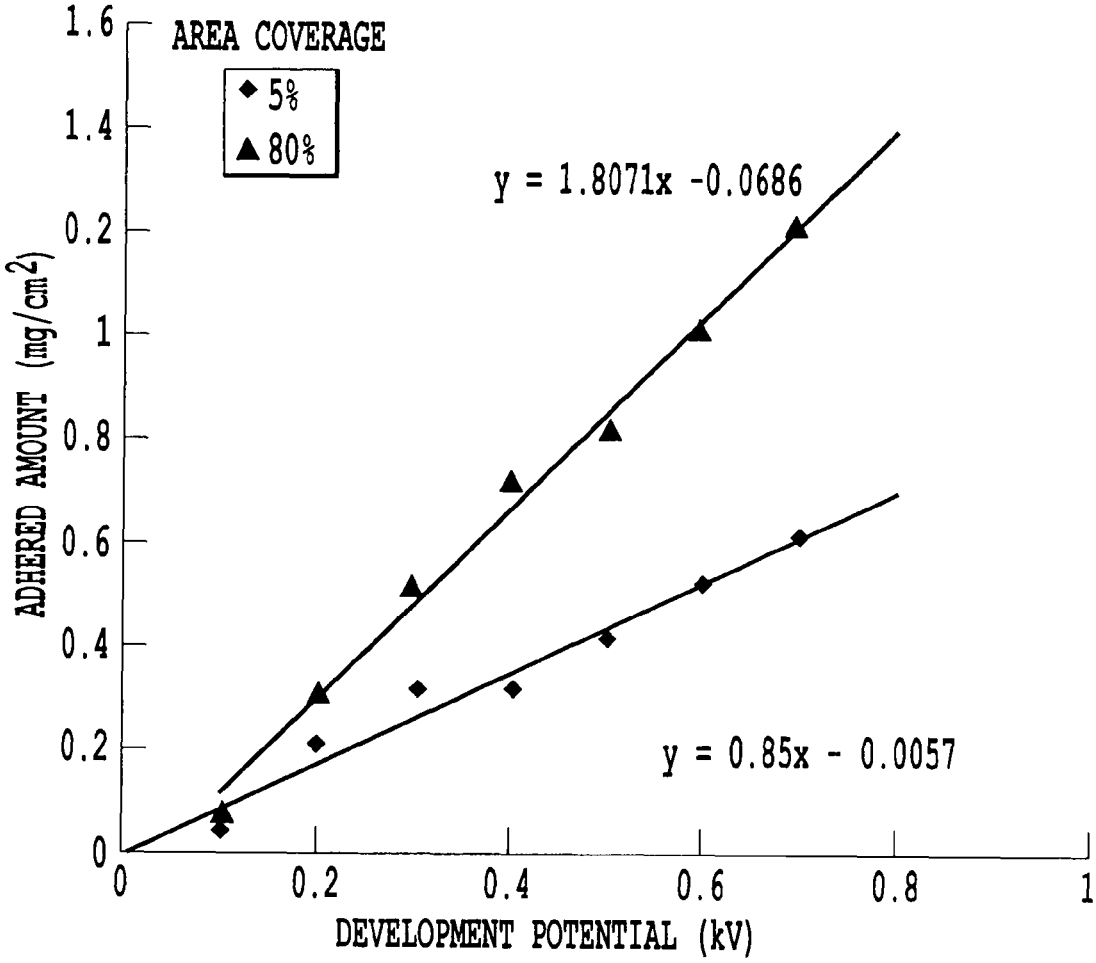
FIG. 5 is a graph showing differences in development γ in accordance with output image coverage ratio.

FIG. 5 is a graph that shows the difference in development γ according to the output image coverage ratio (gradient of the relational expression of toner affixing amount to development potential). The graph indicates values obtained when 100 copies of an identical image coverage ratio image have been continuously output at a standard line speed mode (138 [mm/sec]). As is clear from this graph, the development γ is higher in output images of high image coverage ratio. This is thought to be for the following reasons. That is to say, because of the large amount of toner replacement in the development apparatus 20 in a fixed time period when an image of high image coverage ratio is output, only a small amount of toner is present for a comparatively long time in the development apparatus 20. Accordingly, only a small amount of toner is thought to be excessively charged and, as a result, a higher development capability than possible when an image of low image coverage ratio in which there is a large amount of toner present in the development apparatus 20 for a comparatively long time (excessively charged toner) is output can be exhibited.

Differences in development capability arise during subsequent image formation as a result of the differences in toner replacement amount of the development apparatus 20 that occur in a fixed time period in this way. When differences in development capability occur differences in the image density of the formed images also occur and, accordingly, image formation at a constant image density cannot be performed. Thereupon, even if the toner replacement amount of the development apparatus 20 differs in a fixed time period, the target output value $Vt_{ref}$ is corrected to maintain a constant development capability. Fundamentally, the target output value $Vt_{ref}$ is corrected to ensure the development γ is constant. The toner density is adjusted so that, if the target output value $Vt_{ref}$ is corrected, the output value Vt of the magnetic permeability sensor 26 approximates the target output value $Vt_{ref}$ of the subsequent correction. As a result, the toner density is increased to raise the development capability when the toner replacement amount of the development apparatus 20 is large as is the case when an image of high image coverage ratio is output, or the toner density is decreased to lower the development capability when the toner replacement amount of the development apparatus 20 is small as is the case when an image of low image coverage ratio is output and, in this way, the development capability is made constant.

Moreover, the toner replacement amount of the development apparatus 20 for a fixed time period can be ascertained from various information such as the output image coverage [$cm^2$] and image coverage ratio [%]. The present embodiment describes the ascertaining toner of replacement amount on the basis of image coverage ratio that is the most easily understandable example means thereof. As described hereinafter, the utilization of the image coverage ratio [%] is based on conversion to a unit of toner replacement amount [mg/page]. When a 100% solid image is output onto an A4 transfer paper in the present embodiment when an appropriate development capability is being exhibited, 300 [mg] of toner will be consumed and 300 [mg] of replacement toner will be supplied. Accordingly, in this case, the toner replacement amount is 300 [mg/page]. However, when the image coverage ratio is converted to a toner replacement amount when, for example, the standard transfer paper is set as an A4 long-edge feed paper, the conversion and so on of the image coverage ratio must be based all the output transfer paper being converted to standard transfer paper. The developer volume of the development apparatus 20 of the present embodiment is 240 [g].

Figure 6:
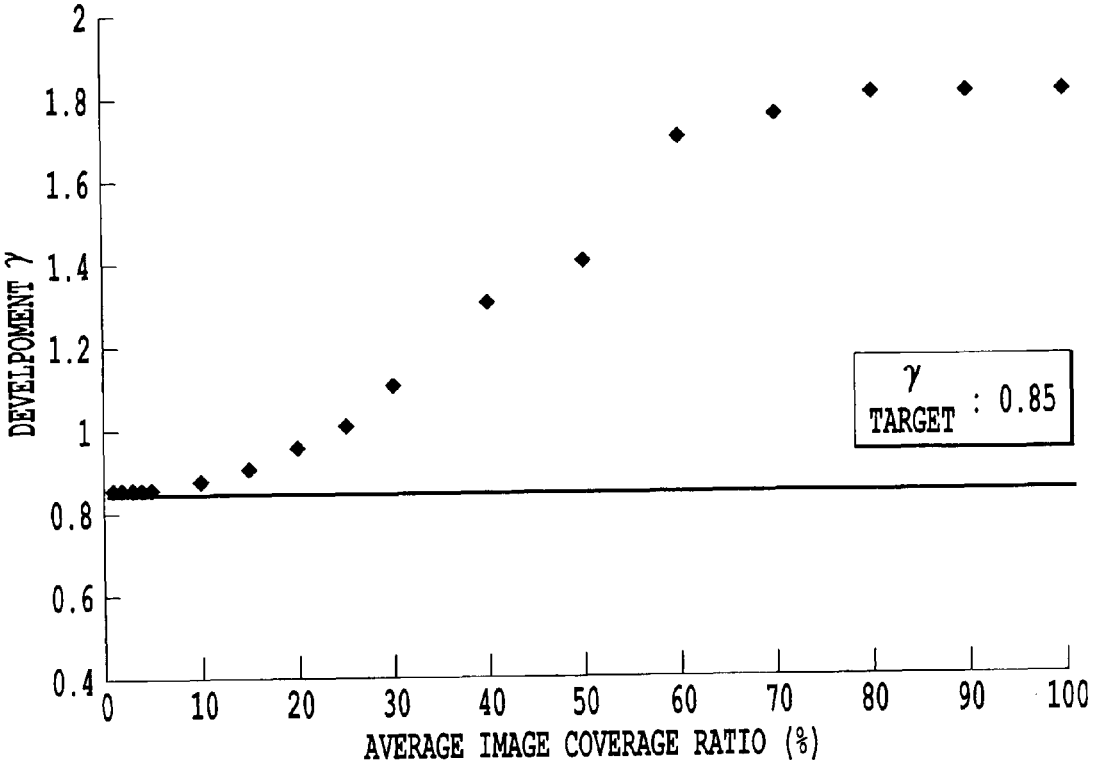
FIG. 6 is a graph in which the horizontal axis denotes the image coverage ratio and the vertical axis denotes development γ.

FIG. 6 is a graph that denotes image coverage ratio [%] on the horizontal axis and development γ [(mg/cm$^2$)/kV] on the vertical axis. This graph, similarly to the graph shown in FIG. 5, describes values obtained following the continuous printing of 100 copies at each image coverage ratio at a constant toner density using a standard line speed mode. It is clear from this graph that the development γ tends to increase once the image coverage ratio exceeds 5[%]. Accordingly, the printer of the present embodiment desirably maintains a constant image density by raising the target output value $Vt_{ref}$ to induce a decrease in the toner density and a drop in the development γ when the image coverage ratio is higher than 5[%]. Conversely, when an image coverage ratio not more than 5[%] is output after the target output value $Vt_{ref}$ has been increased, it must lower the target output value $Vt_{ref}$ to induce an increase in the toner density.

Figure 7:
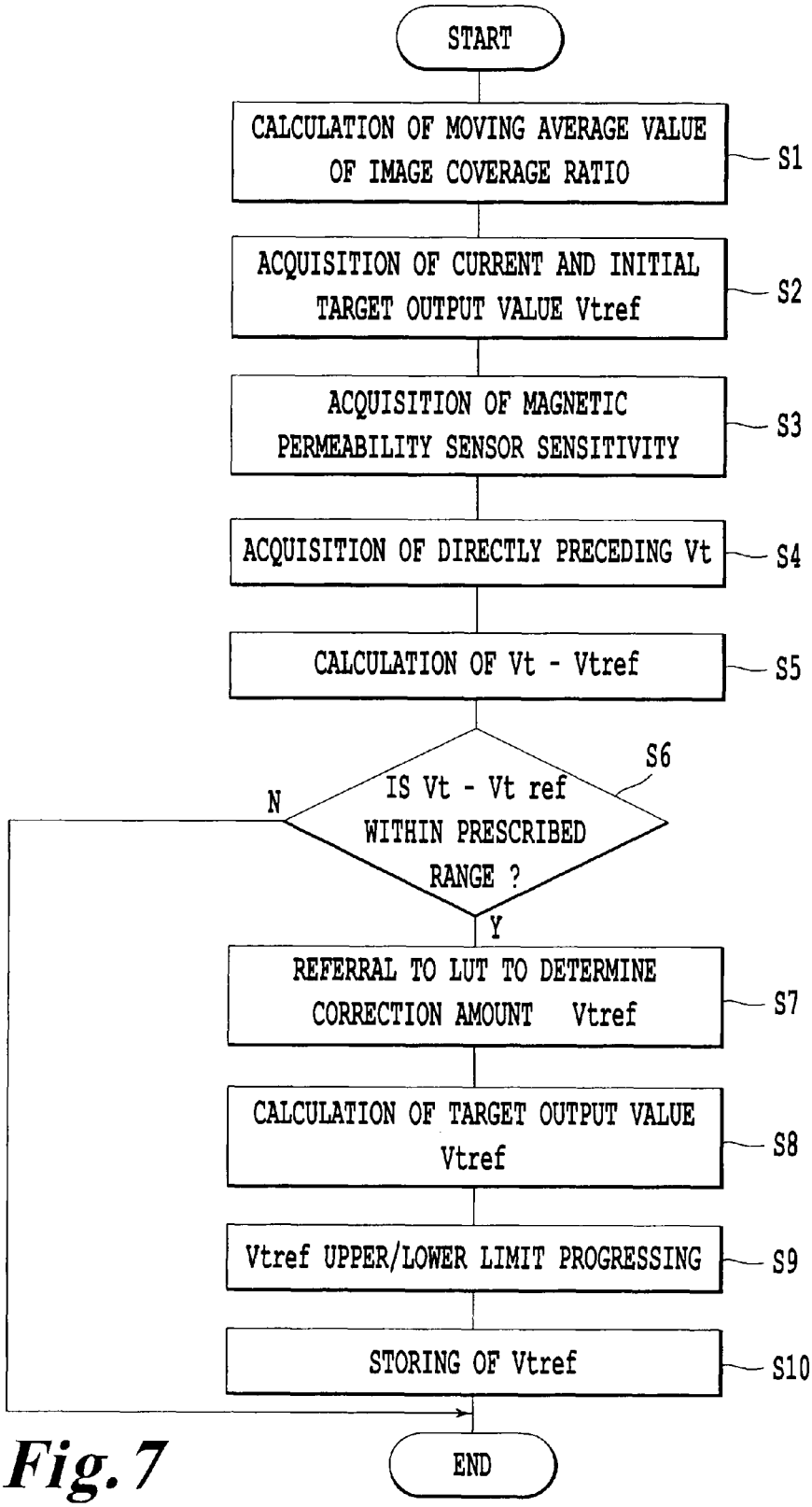
FIG. 7 is a flow chart showing the steps in the target output value correction processing of the laser printer.

FIG. 7 is a flow chart showing the steps in the target output value correction processing of the present embodiment.

The target output value correction processing is executed at the completion of each print JOB. When a print JOB is completed, the control unit 100 calculates the average value of the image coverage ratio [%] from image coverage ratio [%] history information of an output image (S1). In each calculation of the average value of the image coverage ratio [%], the image coverage ratio [%] is calculated for each individual sheet of transfer paper from the size of the transfer paper and the image coverage ratio [cm$^2$] of the output image. Thereupon, while the average value of the image coverage ratio [%] may represent a total average value (cumulative average value) obtained as an average of all the transfer paper that has been printed from a particular previous point in time (for example, from when a process control such as electric potential control is performed), it may also represent a moving average value. The moving average value represents an average value of the image coverage ratio [%] of output images of a directly preceding fixed number of copies (fixed time period), for example, a directly preceding several copies or several tens of copies. The history of the toner replacement amount for a previous several tens of copies, which is suitable for understanding current developer characteristics, can be ascertained by employing a moving average value of the image coverage ratio [%]. Accordingly, the moving average value is employed in the present embodiment.

While the moving average value of the image coverage ratio [%] may also simply represent an average value of each previous several sheets, for reasons of simplicity an average value calculated in accordance with the expression (1) indicated below is employed in the present embodiment. Here, "N" denotes the image coverage ratio sampling number (number of sheets of transfer paper), "M(i−1)" denotes the previously calculated moving average value, and "X(i)" denotes the current image coverage ratio. M(i) and X(i) are individually calculated for each color.

$$M(i)=(1/N)(M(i-1)\times(N-1)+X(i)) \qquad \text{Expression (1)}$$

As in the present embodiment, because the current moving average value is determined employing the previously calculated moving average value, the need for image coverage ratio data for several sheets or several tens of sheets to be stored in the RAM 103 is eliminated and, as a result, the usage region of the RAM 103 can be markedly reduced. In addition, control response can be altered by altering as appropriate the number of sheets of transfer paper N serving as the target for calculation of the average value. For example, control can be more effectively performed by changing the number of sheets of transfer paper N over time or in accordance with environmental fluctuations.

When the moving average value of the image coverage ratio is calculated as described above, the control unit 100 then acquires from the $Vt_{ref}$ resistor the current target output value $Vt_{ref}$ and the initial target output value $Vt_{ref}$ (S2). In addition, the control unit 100 acquires sensitivity information of the magnetic permeability sensor 26 (S3). The sensitivity of the magnetic permeability sensor 26 is expressed using the unit [V/(wt %)] and is a value peculiar to the sensor (the absolute value of the gradient of the straight line plotted in FIG. 5 denotes sensitivity). In addition, the control unit acquires the directly preceding output value Vt of the magnetic permeability sensor 26 (S4) and, using the current target output value $Vt_{ref}$ acquired from S2, calculates $Vt-Vt_{ref}$ (S5). Following this, the control unit 100 judges whether or not the target output value $Vt_{ref}$ is to be corrected. For example, as judgment criteria it uses whether or not the processing control such as the preceding electric potential control has been successful or not or whether or not the result of the $Vt-Vt_{ref}$ calculated in S5 is within a prescribed range or not. In the present embodiment a judgment to whether or not the result of the $Vt-Vt_{ref}$ calculated by S5 is within a prescribed range or not is made (S6).

When the result of the $Vt-Vt_{ref}$ is within the prescribed range a correction amount $\Delta Vt_{ref}$ is determined by reference to an LUT (look-up) reference table (S7). More specifically, the LUT is initially referred to, and a toner density correction amount ΔTC (amount by which the toner density is altered) correspondent to the moving average value calculated by Sl is determined. After the toner density correction amount ΔTC has been determined, the target output value correction amount $\Delta Vt_{ref}$ is calculated from the below-noted expression (2) employing the sensitivity of the magnetic permeability sensor 26 acquired in S3. The calculated correction amount $\Delta Vt_{ref}$ is stored in the RAM 103. The correction amount $\Delta Vt_{ref}$ is individually calculated for each color.

$$\Delta Vt_{ref}=(-1)\times\Delta TC\times(\text{sensitivity of magnetic permeability sensor 26}) \qquad \text{Expression (2)}$$

FIG. 8 shows an example of an LUT 26 in which the sensitivity of the magnetic permeability sensor is 0.3.

The LUT used in the present embodiment is produced employing the following method.

Figure 9:
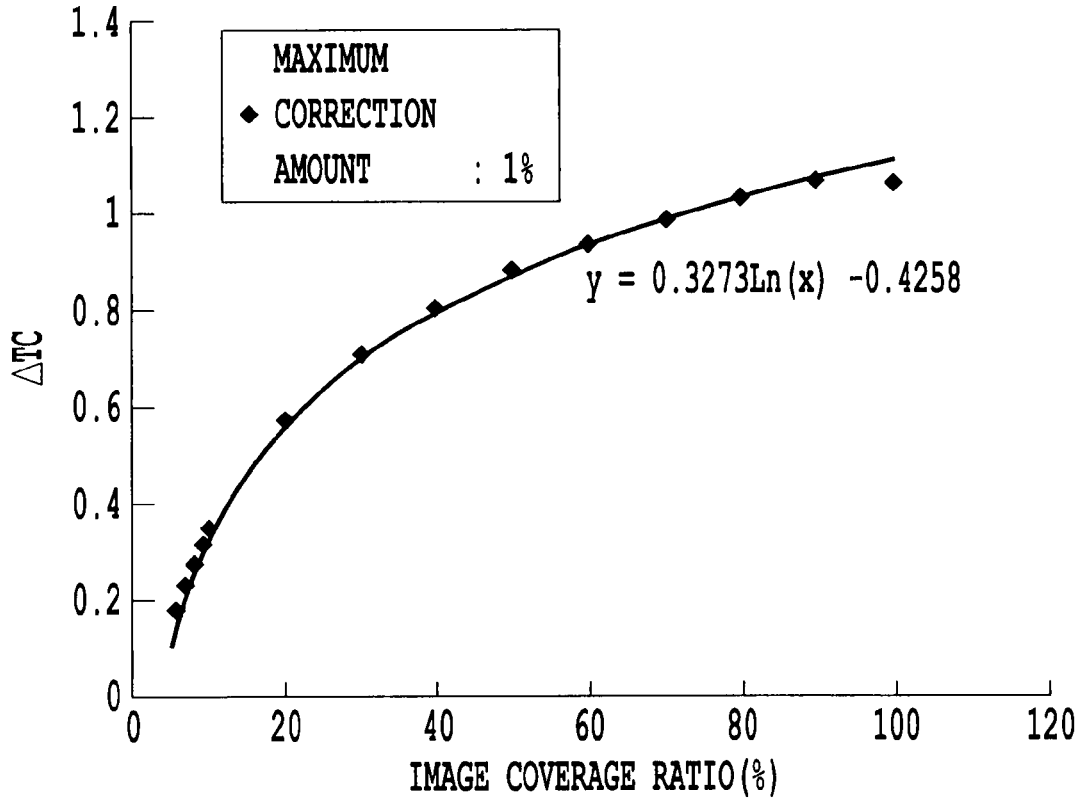
FIG. 9 is a graph in which the horizontal axis denotes a moving average value of the image coverage ratio and the vertical axis denotes a quantity by which the toner density is changed with respect to a standard toner density to ensure the development γ is made constant.

FIG. 9 is a graph in which the horizontal axis denotes the moving average value of the image coverage ratio [%] and the vertical axis denotes the minus direction toner density correction amount for altering the toner density with respect to a standard toner density to ensure a constant development γ is maintained [wt %]. It is clear from this graph that, for example, a constant development γ is maintained when the moving average value of the image coverage ratio is 80% and a toner density control is performed using a toner density correction amount ΔTC of −1 [wt %]. The toner density correction amount ΔTC with respect to the moving average value of the image coverage ratio can be approximated most precisely by logarithm approximation. For this reason, the toner density correction amount ΔTC with respect to the average moving value employed in the LUT is determined employing the method of logarithmic approximation. In the present embodiment, as shown in FIG. 8, the correction step is implemented in 1% increments when the moving average value is less than 10%, and the correction step is implemented in 10% increments when the moving average value is 10% or greater. The correction step is able to be altered as required in accordance with the characteristics of the developer and the development apparatus.

In addition, because the usage conditions of the developer are different for each color, various conditions, including the correction step and the execution timing of the target output value correction processing, can be made different for each development apparatus 20. It is particularly desirable that the maximum correction amount be adjusted for each color. In this case, replacing expression (2) above, expression (3) indicated below is employed.

$$\Delta Vt_{ref}=(-1)\times\Delta TC\times(\text{sensitivity of magnetic permeability sensor 26})\times(\text{color correction coefficient}) \quad \text{Expression (3)}$$

Once the correction amount $\Delta Vt_{ref}$ has been determined with reference to the LUT as described above (S7), the control unit 100 then calculates for each color a post-correction target output value $Vt_{ref}$ from the determined correction amount $\Delta Vt_{ref}$ and the initial value of the $Vt_{ref}$ acquired from S2 based on the expression (4) indicated below (S8).

$$(\text{Post-corrected } Vt_{ref})=(\text{initial value of } Vt_{ref})+\Delta Vt_{ref} \quad \text{Expression (4)}$$

Next, the control unit 100 executes an upper/lower limit processing of the calculated $Vt_{ref}$ (S9). More specifically, when the calculated $Vt_{ref}$ exceeds the upper limit value determined in advance, the upper limit value is taken to be the post-corrected $Vt_{ref}$. On the other hand, when the calculated $Vt_{ref}$ falls short of the lower limit value determined in advance, this lower limit value is taken to be the post-corrected $Vt_{ref}$. Moreover, when the calculated $Vt_{ref}$ is between this upper limit value and the lower limit value, this calculated $Vt_{ref}$ is taken as the post-corrected $Vt_{ref}$. The post-corrected $Vt_{ref}$ obtained in this way is stored in the RAM 103 as the current $Vt_{ref}$ value (S10).

A comparative test example involving a comparison of a case when the target output value correction processing described above has been performed and when it has not been performed will be hereinafter described.

Figure 10:
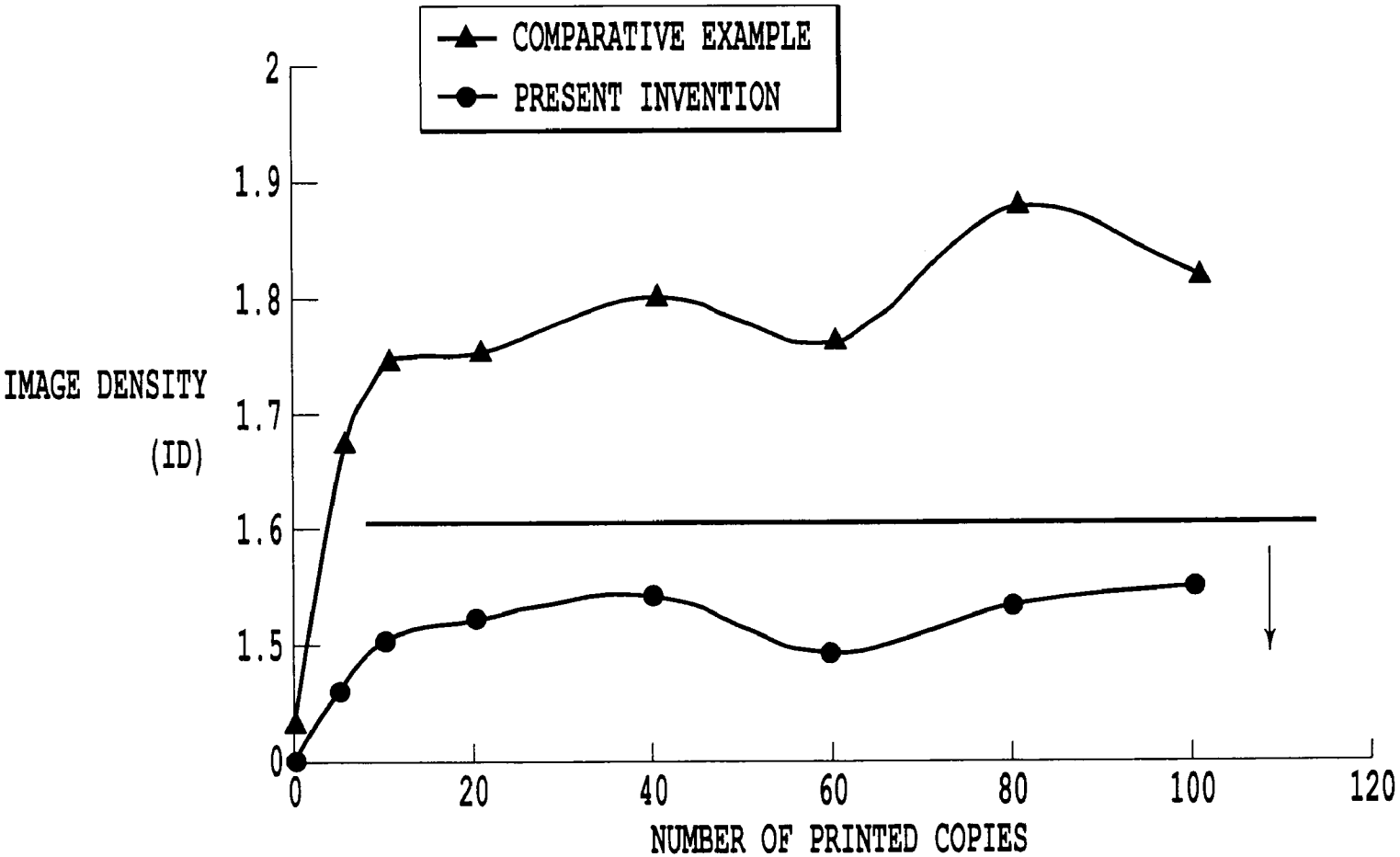
FIG. 10 is a graph showing the effects of a comparative test example.

FIG. 10 is a graph showing the results of this comparative test example. The laser printer of the embodiment described above was employed in this comparative test example, image density being measured when 100 copies of a solid image of image coverage ratio of 80% at standard line speed mode (138 [mm/sec]) were continuously formed. In the comparative example plotted on the graph as triangles there was no target output value correction processing employed and, therefore, an increase in image density occurred accompanying an increase in the number of continuous printed copies. In contrast, in the present embodiment plotted on the graph as circles the target output value correction processing was employed and, therefore, even as the number of continuous printed copies increased the image density was maintained within a substantially constant range. It was confirmed as a result that, even when an image of high image coverage ratio in which there is a large toner replacement amount is output, a stabilized constant image density can be produced by executing the target output value correction processing of the present embodiment.

The laser printer serving as the image forming apparatus pertaining to the embodiment described above comprises a photoreceptor 11 as a latent image carrier, a development apparatus 20 that carries a developer containing a toner and a magnetic carrier on a development sleeve 22 serving as a developer carrier and which performs development in which, as a result of the developer on the development sleeve 22 being brought into contact with the surface of the photoreceptor 11, toner is adhered to the latent image on the surface of the photoreceptor 11, a powder pump 27Y serving as a toner supply apparatus for supplying toner to the development apparatus 20, magnetic permeability sensor 26 as toner density detection means for detecting and outputting the toner density of the developer in the development apparatus 20, a control unit 100 serving as toner density control means for controlling the toner density of the developer so that the output value of the magnetic permeability sensor 26 approximates the target output value $Vt_{ref}$ serving as a toner density control standard value, and a secondary transfer roller 3 serving as transfer means for transferring the image of the photoreceptor 11 to the transfer paper serving as a transfer material. Also, in the laser printer, the control unit 100 functions as correction means and, on the basis of image coverage ratio history information of the output image determined from the transfer paper size and the image coverage of the output image transferred to the transfer paper, ascertains the toner replacement amount in the development apparatus 20 and corrects the target output value $Vt_{ref}$. Even when image forming that involves a significant change in the toner replacement amount in the development apparatus 20 as a result of this correction is performed, for example, even when an image of high image coverage ratio is output, the toner density is adjusted to maintain the development capability at a constant, and a constant image density is ensured. Moreover, using this laser printer, because information for ascertaining the toner replacement amount of the development apparatus 20 (image coverage ratio) can be detected without consuming toner, toner does not need to be used to correct the target output value $Vt_{ref}$.

In addition, the history information of the present embodiment described above constitutes a moving average value of the image coverage ratio per transfer material as determined for a prescribed number of transfer materials output prior to the implementation of the correction. By employing the moving average value of the image coverage ratio, the history of the toner replacement amount for a previous several sheet amount useful for recognizing current developer characteristics can be ascertained. As a result, the target output value $Vt_{ref}$ can be more appropriately corrected.

In addition, in the present embodiment, the control unit 100 refers to a reference table (LUT) prepared in advance which displays the relationship between a plurality of the moving average values and the correction amount of the toner density to be altered in order to maintain a constant development capability, determines the toner density correction amount $\Delta T$ correspondent to the calculated result of the moving average values, and detects the correction amount of the target output value $Vt_{ref}$ in accordance with the determined toner density correction value $\Delta T$. By employing a target output value $Vt_{ref}$ corrected by a correction amount calculated in this way, the amount by which the toner charge in the developer of the development apparatus is in excess or is in shortfall are adjusted by the toner density to ensure a constant development potential is maintained.

In the present embodiment the control unit 100 may ascertain the toner replacement amount in the development apparatus 20 and correct the target output value $Vt_{ref}$ on the basis of the image coverage history information of the output images transferred onto the transfer paper rather than the image coverage ratio noted above. Even when image forming that involves a significant change in the toner replacement amount in the development apparatus 20 as a result of this correction is performed, for example, even when an image of high image coverage ratio is output, the toner density is adjusted to maintain the development capability at a constant, and a constant image density is ensured. Moreover, because the information (image coverage ratio) for ascertaining the toner replacement amount of the development apparatus 20 can be detected without consuming toner, toner need not be used for correcting the target output value $Vt_{ref}$.

In addition, the history information of the present embodiment may represent a cumulative average value of the image coverage ratio per transfer material determined for transfer materials output prior to the implementation of the processing from a certain previous point in time. In this case, the cumulative toner replacement amount history is ascertained from a specific previous point in time (for example a directly preceding point in time when a process control such as electric potential control is performed) and can be reflected in the correction of the target output value $Vt_{ref}$.

In addition, it is preferable that in the present embodiment when the size of the transfer material differs from a standard size (A4-size) established in advance, the control unit 100 change the calculated number of sheets of transfer paper in accordance with this size. In the present embodiment, when the size of the transfer paper differs even when the image coverage ratio [%] is the same, the toner replacement amount in the development apparatus 20 differs. For example, comparing the feed of an A4-size paper at image coverage ratio 100% and an A3-size transfer paper at image coverage ratio 100%, naturally, the toner replacement amount is greater for the feed of an A3-size transfer paper. More specifically, while the toner replacement amount for each individual sheet of A4-size transfer paper is 300 [mg/page], the toner replacement amount for each individual sheet of A3-size transfer paper is twice that 600 [mg/page]. Despite the fact that the toner replacement amount is doubled in this way for A3-size transfer paper, when the calculation processing of the moving average value of the image coverage ratio is performed, only a single sheet of A4 transfer paper of standard size is updated to serve as the history information of a 100% image coverage ratio output image. Thereupon, more specifically in the present embodiment, for an A3-size transfer paper in which the length in the sub-scanning direction is twice that of an A4-size transfer paper, a double count, that is to say, two sheets of standard size A4 transfer paper are counted. As a result, when an A4-size transfer paper of image coverage ratio 100% and an A3-size transfer paper of image coverage ratio 100% are fed, the history information is updated for these two sheets of fed paper using three sheets of standard size A4-size transfer paper assumed to have an image coverage ratio of 100%, 100%, 100%. As a result, more precise judgments of toner replacement amount can be made and differences in toner replacement amount can be reflected more quickly in the control.

Figure 11:
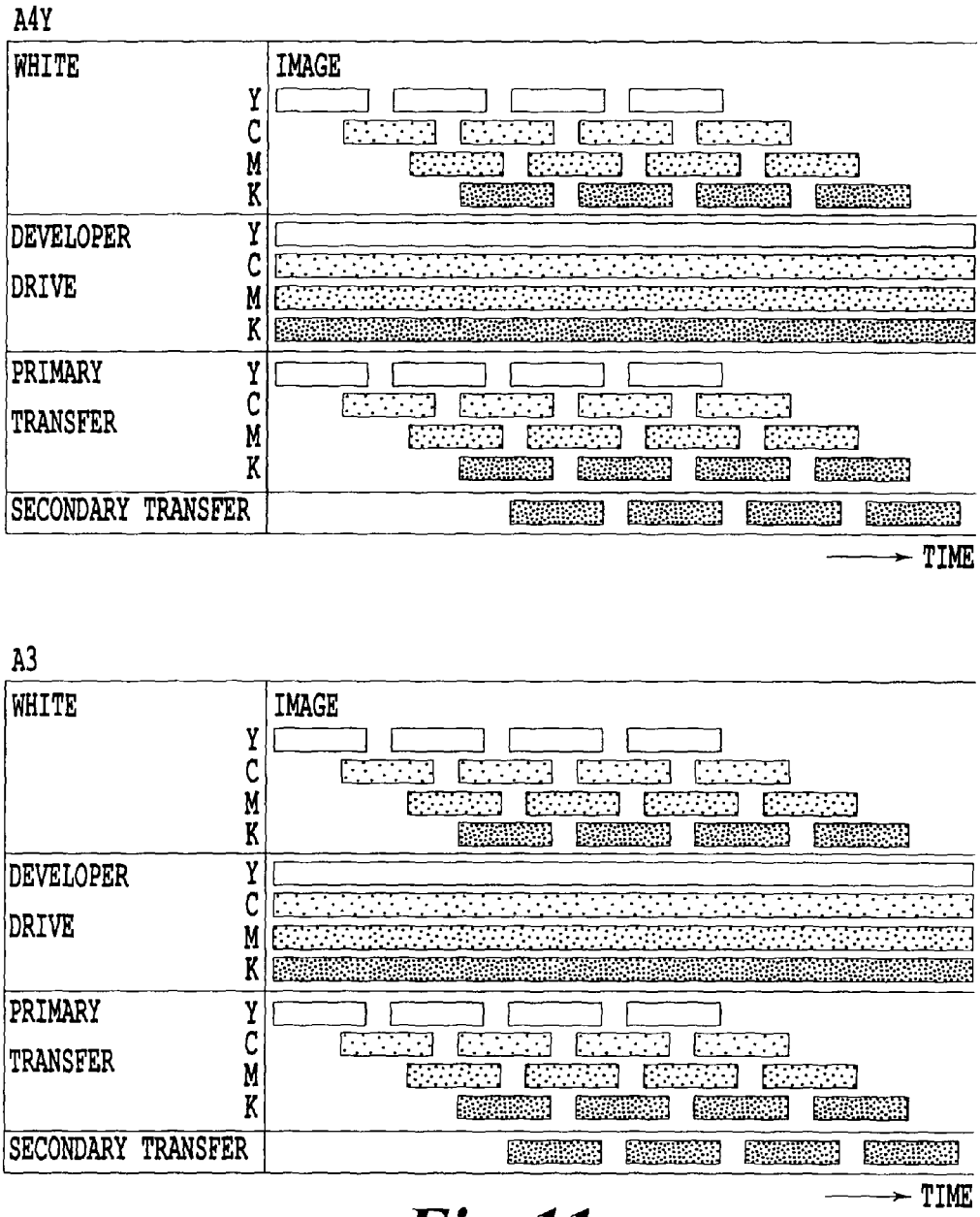
FIG. 11 is a timing chart of the image formation process for a long-edge feed A4-size transfer paper A4Y and an A3-size transfer paper.

Furthermore in the present embodiment, when transfer paper of different length and width is used, the drive time of the development apparatus 20 in the image forming step for forming images image on the transfer paper (developer agitation time) differs depending on the feed direction thereof (sub-scanning direction on the photoreceptor 11). For example, the drive time of the development apparatus 20 (developer agitation time) for a long-edge feed A4-size transfer paper A4Y is shorter than for a short-edge feed paper A4T. This is clear from the timing chart of the image formation steps for a long-edge feed A4-size transfer paper A4Y and an A3-size transfer paper as shown in FIG. 11.

Thereupon, in the present embodiment, the control unit 100 may perform a control so that the correction amount of the target output value $Vt_{ref}$ is amended in accordance with the orientation of the moving transfer paper when an image is being transferred. For example, the agitation time of the development apparatus 20 is adjusted and the correction amount of the target output value $Vt_{ref}$ is amended on the basis of a length Y of the feed direction of the transfer paper (sub-scanning direction). In addition, instead of this Y, the correction amount of the target output value $Vt_{ref}$ may be amended on the basis of a ratio A/Y of an image coverage A of the image output to the transfer paper and the length Y in the feed direction (sub-scanning direction) of the transfer paper. In addition, instead of the ratio A/Y, a ratio of the image coverage ratio and the sub-scanning direction length Y of the transfer paper, or a ratio of the toner replacement amount determined by judgment from the image coverage ratio or the like and the sub-scanning direction length Y of the transfer paper may be employed. Here, when this Y is long or the ratio is small, the correction amount of the output value $Vt_{ref}$ is amended on the basis of a judgment that the agitation time in the development apparatus 20 is longer and the shortfall toner charge amount is small. Conversely, when this Y is short or the ratio noted above is large, the correction amount of the output value $Vt_{ref}$ is amended on the basis of the judgment that the agitation time in the development apparatus 20 is shorter and the shortfall toner charge amount is large.

By amending the correction amount of the target output value $Vt_{ref}$ in this way, even when the image coverage ratio (image coverage) is the same using transfer paper of the same size, because the difference in agitation time of the developer in the through-pass period between the short-edge feed and long-edge feed transfer papers when they pass the secondary transfer position is taken into consideration, a more accurate control of image density is possible. More specifically, for example, while toner replacement of 300 [mg] is performed when a solid image (image coverage ratio 100%) is formed on an A4-size transfer paper, the length Y in the feed direction (sub-scanning direction) of a long-edge feed A4-size transfer paper A4Y transfer paper is 210 [mm]. In this case, similarly to the control described above, the correction amount of the target output value $Vt_{ref}$ is calculated taking the image coverage ratio to be 100[%]. On the other hand, the length Y in the feed direction (sub-scanning direction) of a short-edge feed A4-size transfer paper A4T is 297 [mm] and is 1.41 times that of the long-edge feed paper A4T. Accordingly, the correction amount of the target output value $Vt_{ref}$ is amended on the basis of a judgment that agitation time of the developer is longer and the shortfall of the toner charge amount is small.

As is described above, in the present embodiment, how much toner is used in the development apparatus in a prescribed time period and how much new toner is supplied thereto can be ascertained from image coverage history information of output images transferred onto the transfer material or history information of the image coverage ratio of the output images determined from the image coverage and the size of the transfer material. That is to say, the percentage of new toner and the percentage of old toner present in the development apparatus can be ascertained. Because, by virtue of this, the development capability can be ascertained, a toner density control standard value can be corrected on the basis of image coverage or image coverage ratio history information to ensure a constant development potential of the development apparatus is maintained. As a result, even if image formation in which changes in the toner replacement amount in the development apparatus occur is performed, the development capability can be maintained at a constant by adjustment of the toner density and a constant image density can be produced. Because the image coverage or image coverage ratio history information, different to the forming of images as used in conventional control, can be acquired without consuming toner, toner need not be used for correcting the toner density control standard value.

As described above, the present invention affords the excellent effect whereby a constant image density is able to be obtained by correcting a toner density control target value without consuming toner.

Various modifications will become possible for those skilled in the art after receiving the teachings of the present disclosure without departing from the scope thereof.

What is claimed is:

1. An image forming apparatus, comprising:

a latent image carrier;

a development apparatus in which a developer containing a toner and a magnetic carrier is carried on a developer carrier and which performs development in which, by bringing the developer on the developer carrier into contact with the surface of the latent image carrier, the toner is adhered to the latent image on the surface of the latent image carrier;

a toner supply apparatus which supplies the toner to the development apparatus;

toner density detection means which detects and outputs toner density of the developer in the development apparatus;

toner density control means configured to control the toner density of the developer so that an output value of the toner density detection means approximates a toner density control standard value;

transfer means which transfers an image on the latent image carrier onto a transfer material; and correction means configured to correct and update the toner density control standard value on the basis of image coverage history information of an output image transferred to the transfer material or image coverage ratio history information of an output image determined from the image coverage and the transfer material size, wherein the history information includes a cumulative average value of the image coverage or the image coverage ratio per transfer material determined for the output transfer material from a certain previous point in time until implementation of the correction.

2. The image forming apparatus as claimed in claim 1, wherein the correction means, when the size of the transfer material differs from a standard established in advance, changes the integration number of the transfer material in accordance with this size difference.

3. The image forming apparatus as claimed in claim 1, wherein the transfer material describes a shape in which the size thereof in the vertical direction differs the size in the horizontal direction orthogonal thereto on the surface on which the image is to be transferred and, the development apparatus agitates the developer when an image is being formed, and the correction means amends a correction amount for the toner density control standard value in response to the orientation of the transfer material which moves when the image is transferred.

4. The image forming apparatus as claimed in claim 1, wherein the correction means refers to a reference table prepared in advance in which the relationship between a plurality of the cumulative average values or the moving average values and a correction amount of the toner density that is changed in order to maintain a fixed development potential are displayed, determines the toner density correction amount corresponding to the calculated result of the cumulative average value or the moving average value, and calculates the correction amount of the toner density control standard value in accordance with the determined toner density correction value.

5. An image forming apparatus, comprising:

a latent image carrier;

a development apparatus in which a developer containing a toner and a magnetic carrier is carried on a developer carrier and which performs development in which, by bringing the developer on the developer carrier into contact with the surface of the latent image carrier, the toner is adhered to the latent image on the surface of the latent image carrier;

a toner supply apparatus which supplies the toner to the development apparatus;

toner density detection means which detects and outputs toner density of the developer in the development apparatus;

toner density control means configured to control the toner density of the developer so that an output value of the toner density detection means approximates a toner density control standard value;

transfer means which transfers an image on the latent image carrier onto a transfer material; and correction means configured to correct and update the toner density control standard value on the basis of image coverage history information of an output image transferred to the transfer material or image coverage ratio history information of an output image determined from the image coverage and the transfer material size, wherein the history information includes a moving average value of the image coverage or the image coverage ratio per transfer material determined for a prescribed number of transfer materials output prior to the correction being performed.

6. The image forming apparatus as claimed in claim 5, wherein the correction means, when the size of the transfer material differs from a standard established in advance, changes the integration number of the transfer material in accordance with this size difference.

7. The image forming apparatus as claimed in claim 5, wherein, the correction means refers to a reference table prepared in advance in which the relationship between a plurality of the cumulative average values or the moving average values and a correction amount of the toner density that is changed in order to maintain a fixed development potential are displayed, determines the toner density correction amount corresponding to the calculated result of the cumulative average value or the moving average value, and calculates the correction amount of the toner density control standard value in accordance with the determined toner density correction value.

8. The image forming apparatus as claimed in claim 5, wherein the toner density detection means includes a magnetic-permeability sensor.

9. The image forming apparatus as claimed in claim 5, wherein the moving average value is calculated by $M(i)=(1/N)(M(i-1)\times(N-1)+X(i))$ where N is an image coverage ratio sampling number, $M(i-1)$ is a previously calculated moving average, and $X(i)$ is a current image coverage ratio.

* * * * *